US005823415A

United States Patent [19]

Udagawa et al.

[11] Patent Number: 5,823,415

[45] Date of Patent: Oct. 20, 1998

[54] CARTRIDGE FOR ELECTRIC STAPLER

[75] Inventors: Hiroshi Udagawa; Kazuo Higuchi; Toshiaki Kikuchi, all of Chuo-ku, Japan

[73] Assignee: Max Co., Ltd., Tokyo, Japan

[21] Appl. No.: 777,191

[22] Filed: Dec. 27, 1996

[30] Foreign Application Priority Data

Dec. 28, 1995 [JP] Japan ..... 7-343214

[51] Int. Cl.[6] ..... B27F 7/21

[52] U.S. Cl. ..... 227/120; 227/131; 227/136

[58] Field of Search ..... 227/120, 131, 227/135, 136, 137

[56] References Cited

U.S. PATENT DOCUMENTS 5,273,199 12/1993 Logtens ..... 227/120

5,346,114 9/1994 Udagawa et al. ..... 227/136

5,454,503 10/1995 Udagawa et al. ..... 227/120

5,474,222 12/1995 Kanai et al. ..... 227/120

*Primary Examiner*—Scott A. Smith

*Attorney, Agent, or Firm*—Jacobson, Price, Holman & Stern, PLLC

[57] ABSTRACT

A cartridge used for an electric stapler is provided which comprises a cartridge body (701) containing a pile of sheet-staples (S), a delivering portion (710) mounted on an upper end of a front wall (701F) of the cartridge body (701) and having a delivery path (711) along which the sheet-staple (S) is delivered, and a driving-out portion (720) mounted in a front end of the delivering portion (710). A reciprocating driver enters the driven-out portion (720), so that a U-shaped staple is driven from the driven-out portion (720). The driver enters the driving-out portion 720 from above the delivery path (711).

5 Claims, 18 Drawing Sheets

FIG.16-A
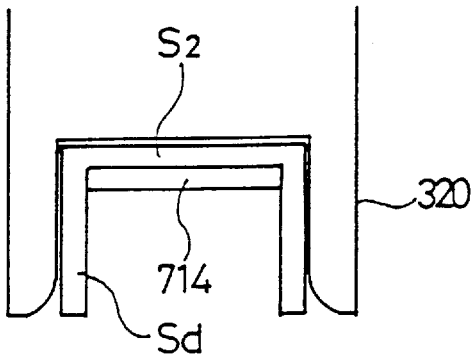
FIG.16-B
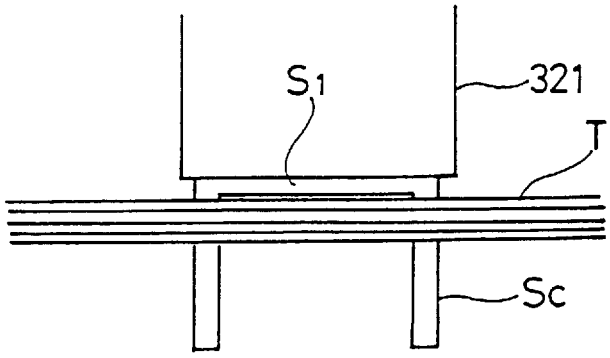

CARTRIDGE FOR ELECTRIC STAPLER

BACKGROUND OF THE INVENTION

1. Field of the Invention

This invention relates to a cartridge used for an electric stapler which comprises a cartridge body containing a pile of sheet-staples, a delivery path portion having a delivery path for delivering the sheet-staples, and a driving-out portion mounted in a front end of the delivery path portion.

2. Description of the Prior Art

Conventionally, an electric stapler is known which is attached to, for example, a copying machine, as shown in FIG. 17.

The conventional electric stapler comprises a cartridge K containing a pile of sheet-staples S, a delivering mechanism E for delivering the sheet-staples S to a driving-out portion U, a driver D for driving the staples from the driving-out portion U while reciprocating, and a table Z on which a clincher (not shown) is disposed for clinching the ends of the driven staple. The cartridge K is detachably mounted in a magazine N (see FIG. 18) which is mounted in a main body H. Reference character W denotes a forming plate which reciprocates along with the driver D and forms the staple into a U-shape.

The delivering mechanism E includes a roller R for delivering the lowest sheet-staple S1 of the piled sheet-staples S contained in the cartridge K forward (i.e., leftward in FIG. 17).

As shown in FIG. 18, the cartridge K comprises a cartridge body Ka, a delivery path portion J mounted in a lower part of a side wall Kb of the cartridge body Ka and having a delivery path T extending forward from the lower part, and a driving-out portion U mounted in a front end of the delivery path portion J. A projection P is formed on a rear part of the cartridge body Ka, and a pusher P (see FIG. 17) is mounted in the driving-out portion U for pushing out a leg of the staple formed into a U-shape by means of the forming plate forwards.

On the other hand, the magazine N includes a driving-out chamber NB, front wall portions Nb, Nc, and a contact surface Nd. The driving-out chamber NB into which the driving-out portion U of the cartridge K is inserted has a contact wall portion Ha which comes in contact with a face plate Uf of the driving-out portion U. By the front wall portions Nb, Nc, a space G is defined for guiding the driver D to the driving-out portion U. The contact surface Nd comes in contact with the lower surface Kc of the cartridge body Ka. The contact wall portion Na is positioned In front of the front wall portion Nc. The face plate Uf of the driving-out portion U is arranged to be positioned in front of the space G when the cartridge K is attached to the magazine N. By this arrangement, the driver D can be inserted from the space G into a space (not shown) of the driving-out portion U and drive the staples.

In the rear part of the magazine N, there is a shaft I pressed forward by the force of a spring V. The shaft I is engaged with an inclined surface Fb of the projection F of the cartridge K, and thereby the cartridge K is fixed in the magazine N.

In the electric stapler thus constructed, the driver D is disposed above the driving-out portion U, and the staples are driven out from the driving-out portion U by the downward movement of the driver D. Therefore, the pusher P must be disposed under the delivery path T. That is, the pusher P is positioned lower than the lowest layer of the piled sheet-staples S.

For this reason, the driving-out portion U projects downward from the lower surface Kc of the cartridge body Ka, and the contact wall portion Na is positioned in front of the front wall portion Nc.

Therefore, the cartridge K cannot be attached merely by inserting the cartridge K from the rear or upper part of the magazine N, and, as shown in FIGS. 18 to 20, the cartridge K must be first inserted from the upper part of the magazine N, the front end of the driving-out portion. U must be then inserted into the driving-out chamber NB, and the rear part of the cartridge K must be pushed downward.

By pushing the rear part of the cartridge K downward, the shaft I is moved backward against the force of the spring V and Is engaged with the inclined surface Fb of the projection F. The lower surface Kc of the cartridge body Ka is then brought into contact with the contact surface Nd of the magazine N, as shown in FIG. 21, and the face plate Uf of the driving-out portion U is positioned by the contact with the contact wall portion Na. Thereafter, the cartridge K is fixed in the magazine N by the engagement of the shaft I with the inclined surface Pb of the projection F.

In order to remove the cartridge K from the magazine N, operations contrary to the above-mentioned operations are carried out. In detail, the rear part of the cartridge K is lifted, so that the engagement of the shaft with the inclined surface Fb of the projection F is released. After that, the driving-out portion U is pulled out from the driving-out chamber NB of the magazine N. and the cartridge N is removed from the magazine N.

As mentioned above, troublesomely, operations must be twice carried out for the attachment of the cartridge K to the magazine N or removal therefrom. Particularly, in a certain type of copying machine, the table Z of the electric stapler must face upward whereas the magazine must face downward. In this case, the cartridge K must be inserted into the magazine N from below to above, and the front end of the driving-out portion U must be then inserted into the driving-out chamber NB of the magazine N. This operation is very difficult.

Likewise, in order to remove the cartridge K from the magazine N, the rear part of the cartridge K must be pushed downward, the driving-out portion U must be then pulled out from the driving-out chamber NB of the magazine N, and the cartridge K must be pulled downward. This operation is also very difficult.

SUMMARY OF THE INVENTION

It is an object of the present invention to provide a cartridge for an electric stapler which can be easily attached to the electric stapler or removed therefrom regardless of the type of an apparatus such as a copying machine.

The present invention is characterized in that a cartridge for an electric stapler comprises a cartridge body containing a pile of sheet-staples, a delivering portion mounted in an end of the cartridge body and having a delivery path for delivering the piled sheet-staples, and a driving-out portion mounted in a front end of the delivering portion. In the cartridge, a U-shaped staple is driven out from the driving-out portion by the entrance of a reciprocating driver into the driving-out portion. The driver is caused to enter the driving-out portion from the end of the cartridge body toward the other end thereof.

BRIEF DESCRIPTION OF THE DRAWINGS

FIG. 16(A) is a descriptive drawing of a staple formed into a U shape.

FIG. 16(B) is a descriptive drawing of the staple which has been driven into and has passed through sheets of paper.

DETAILED DESCRIPTION OF THE EMBODIMENT

Figure 1:
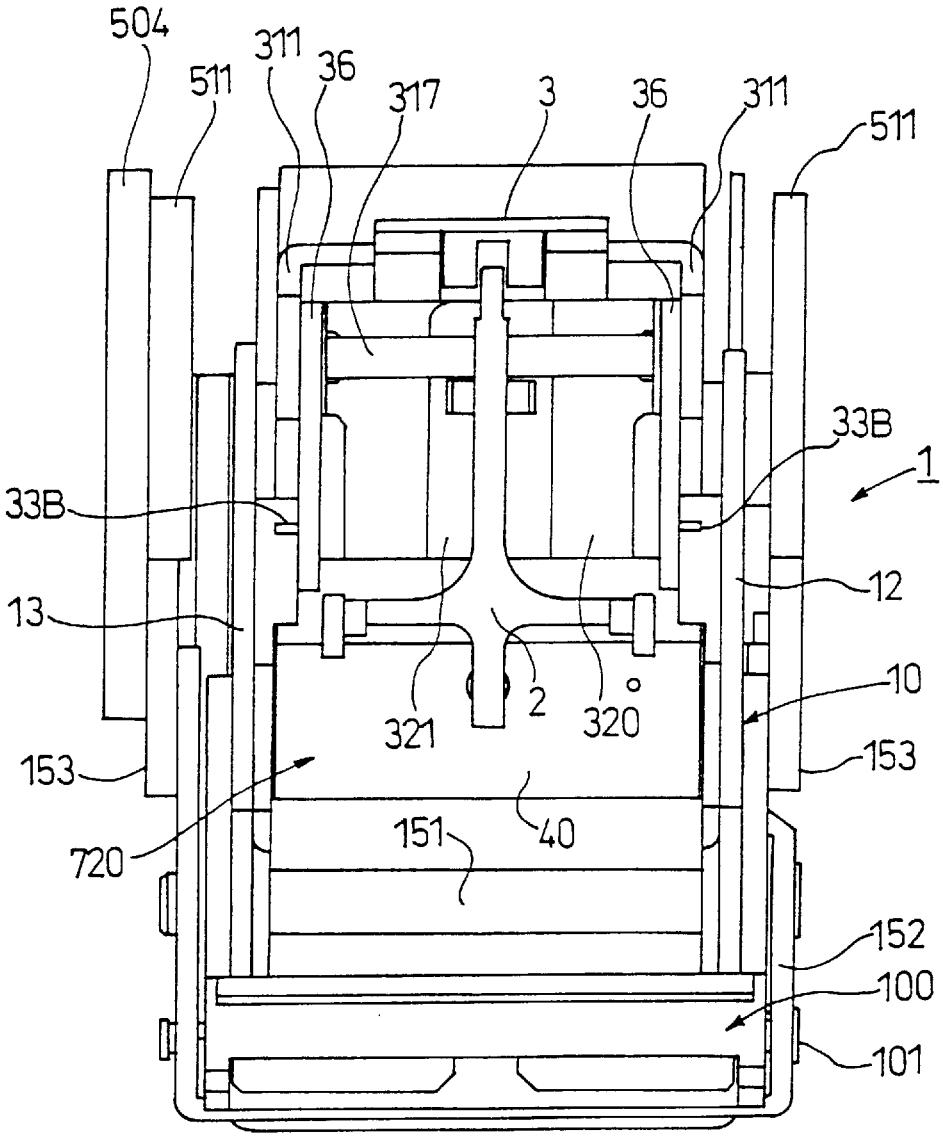
FIG. 1 is a front view showing the exterior appearance of an electric stapler to which a cartridge is attached according to the present invention.
Figure 2:
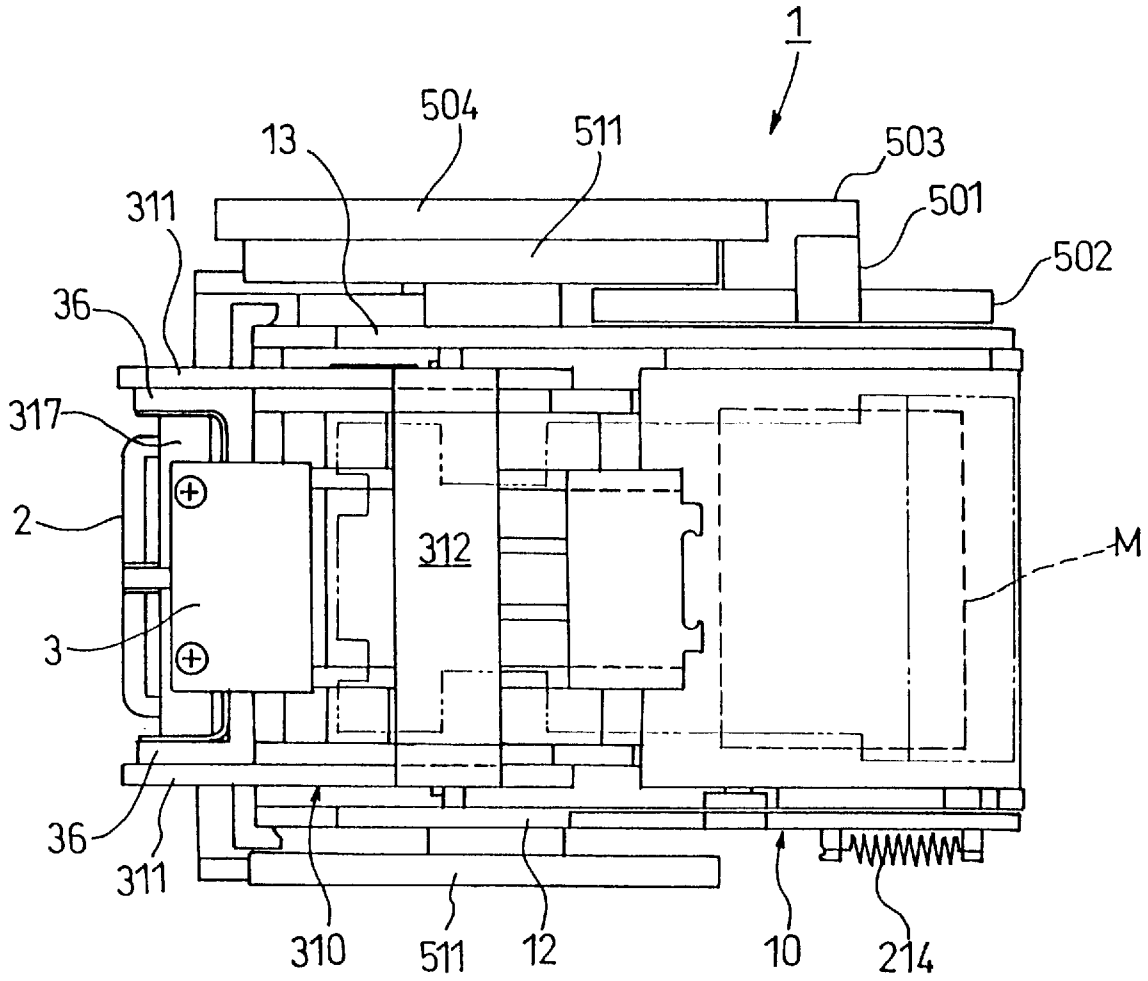
FIG. 2 is a plan view of the electric stapler shown in FIG. 1.

A description will be given of an embodiment of an electric stapler to which a cartridge is attached according to the present invention, with reference to the accompanying drawings.

In FIGS. 1 to 5, reference numeral 1 designates an electric stapler attached to, for example, a copying machine. The electric stapler 1 comprises a stapler body 10 and a cartridge 700 attached to a cartridge chamber 25 formed in the stapler body 10. The cartridge 700 is freely detachable therefrom.

The stapler body 10 comprises a reciprocative table 100, a table mechanism 150 for reciprocating the table 100, a delivering mechanism (not shown) for delivering a pile of sheet-staples S contained in the cartridge 700 to a driving-out portion 720, a driving mechanism 300 for driving the sheet-staples S from the driving-out portion 720, a clinching mechanism (not shown) for clinching the ends of the driven staple, a driving mechanism 500 for driving each of the mechanisms 150, 200, and 300, and a detecting mechanism (not shown) for detecting a position of the table 100. On the front side of the stapler body 10, there are disposed an actuator 2 for detecting whether a U-shaped staple S1 is in an open space 725 of the driving-out portion 720 and a microswitch (not shown) for detecting existence of the staple S1 based on the movement of the actuator 2. In this embodiment, the microswitch is mounted on a base plate S.

[DRIVING MECHANISM 500]

Figure 6:
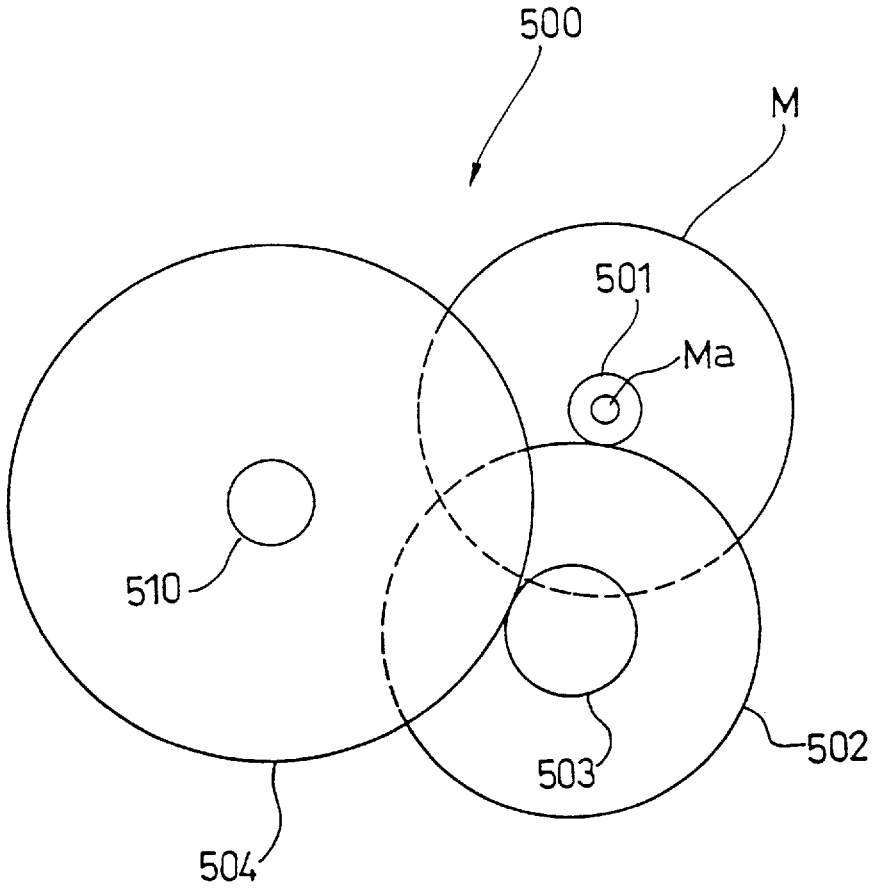
FIG. 6 is a descriptive drawing showing a driving mechanism.
Figure 7:
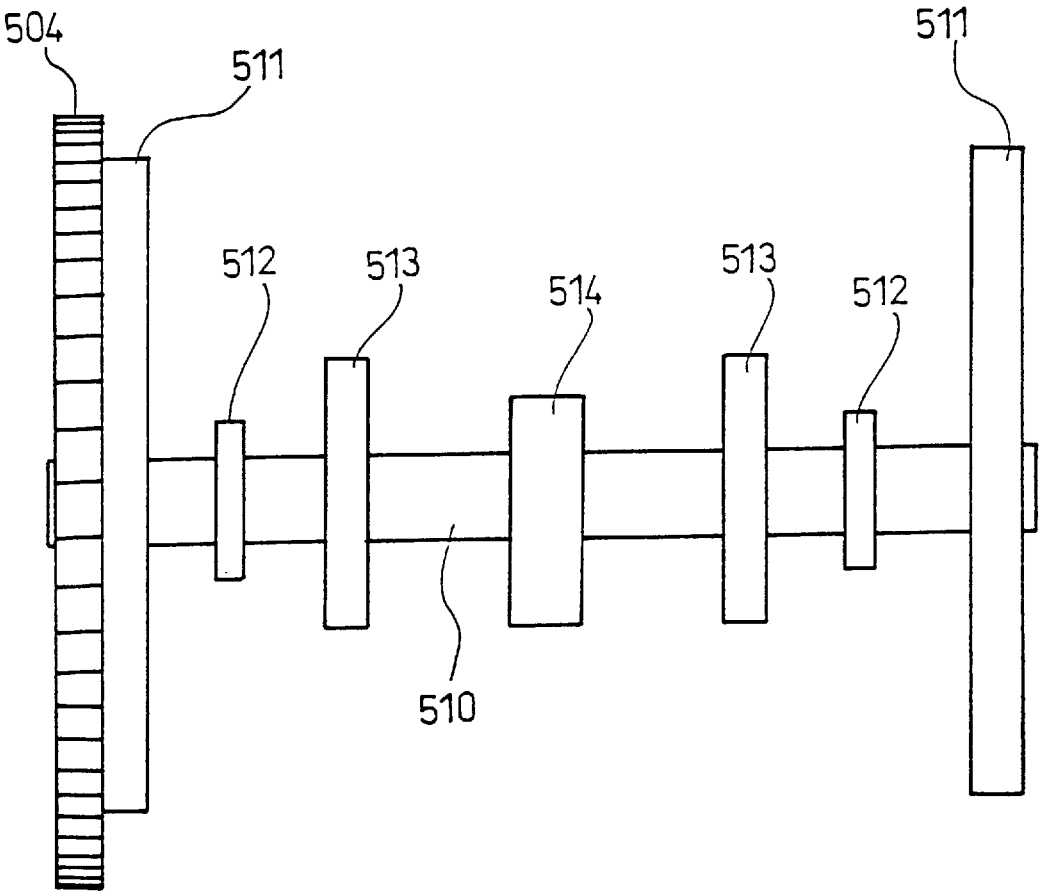
FIG. 7 is a descriptive drawing showing a cam attached to a cam driving shaft.

As shown in FIGS. 6 and 7, the driving mechanism 500 comprises a motor M attached to the stapler body 10, a gear 501 attached to the driving shaft Ma of the motor M, intermediate gears 502, 503 engaged with the gear 501, a driving gear 504 engaged with the intermediate gear 503, and a cam driving shaft 510 rotated along with the driving gear 504.

Figure 3:
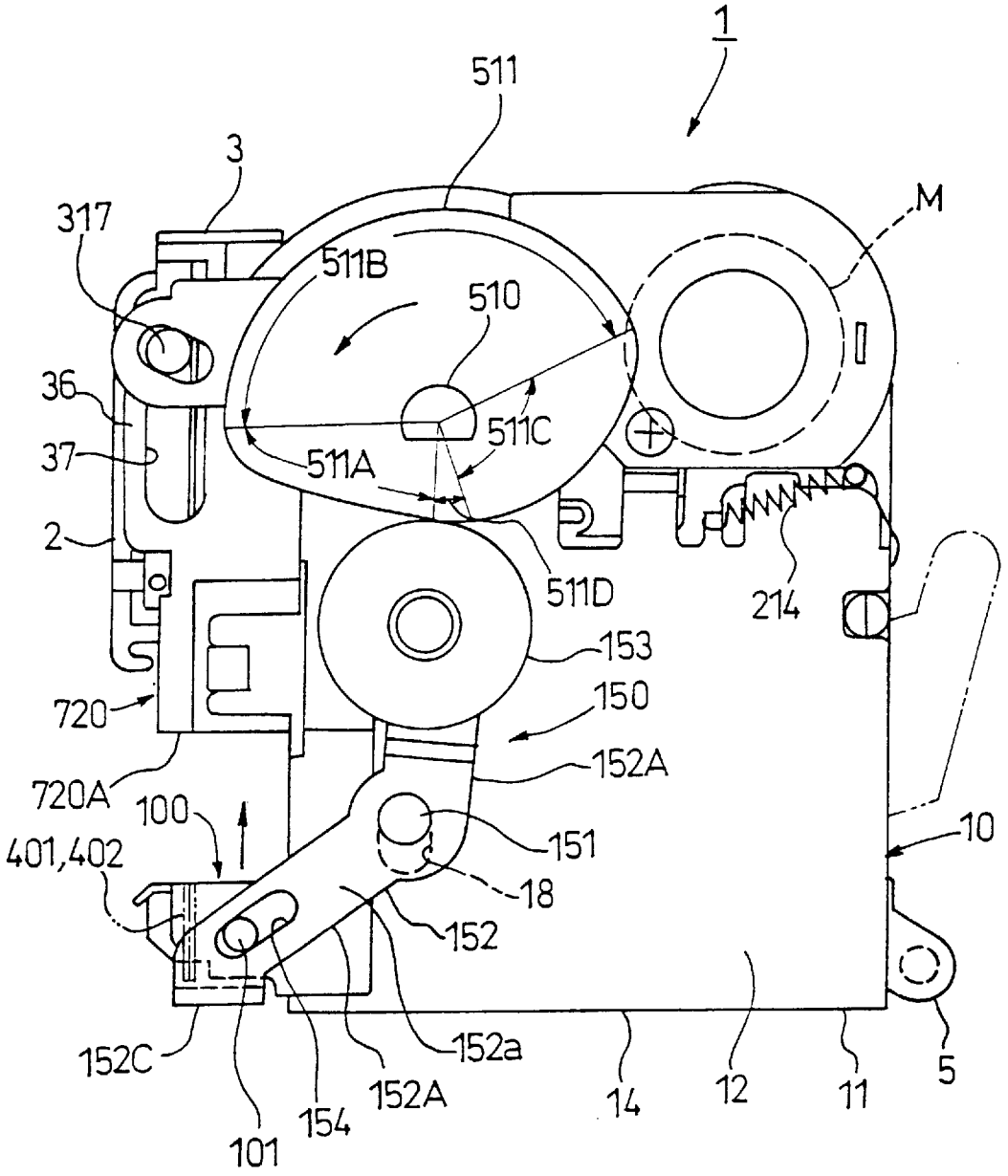
FIG. 3 is a right-hand side view of the electric stapler shown in FIG. 1.

The cam driving shaft 510 is rotated clockwise (in FIG. 4) by the drive of the motor M through the gears 501 to 504 (counterclockwise in FIG. 3).

The cam driving shaft 510 comprises a pair of table cams 511, a pair of delivering cams 512, a pair of driving cams 513, and a clinching cam 514.

Both ends of the cam driving shaft 510 are inserted in the holes 17 formed in the side plates 12, 13 of the frame 14, and the cam driving shaft 510 is rotatably supported. The intermediate gears 502, 503 are attached rotatably to the side plate 13 of the frame 14 (see FIG. 4).

Figure 4:
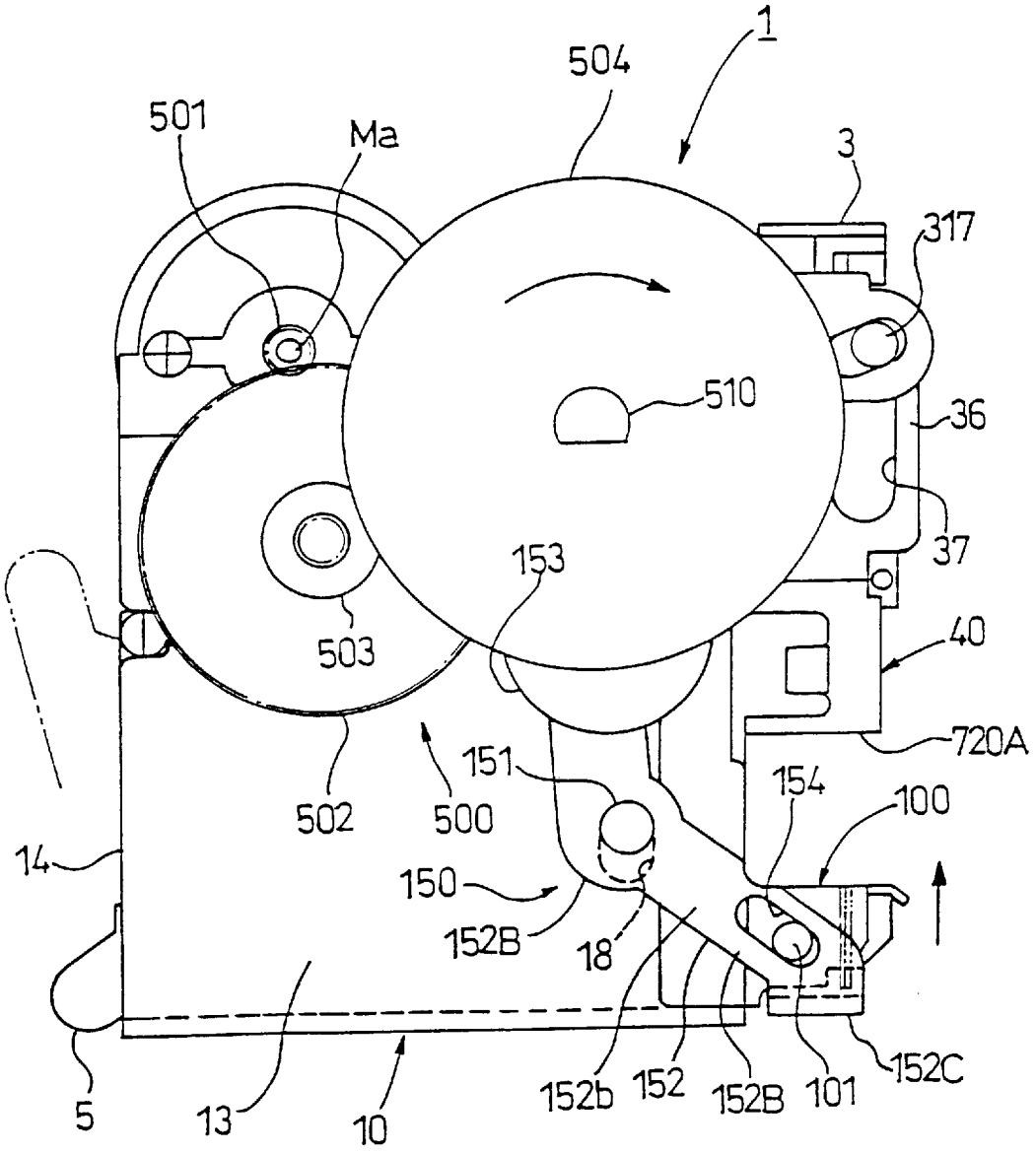
FIG. 4 is a left-hand side view of the electric stapler shown in FIG. 1.

The table 100 is attached reciprocatably to the stapler body 10, as shown in FIGS. 3 and 4, so as to reciprocate (i.e., move upward and downward in FIGS. 3 and 4) by the table mechanism 150.

[TABLE MECHANISM 150]

As shown in FIG. 3, the table mechanism 150 comprises a linking shaft 151 inserted through the long holes 18 of the side plates 12, 13 of the frame 14 so as to move upward and downward, a linking member 152 pivoted on the linking shaft 151, the table cam 511, and a roller 153 which is in contact with the circumferential surface of the table cam 511 and is attached rotatably to the upper part of the linking member 152 (in FIGS. 3 and 4). The linking member 152 is pressed counterclockwise (in FIG. 3) by a spring (not shown), and thereby the roller 153 is always in contact with the circumferential surface of the table cam 511.

As shown in FIG. 3, the table cam 511 comprises an enlarging portion 511A whose radius becomes larger when the table cam 511 rotates counterclockwise, a large-radius portion 511B whose radius is fixed at its maximum, a reducing portion 511C whose radius becomes smaller, and a small-radius portion 511D whose radius becomes the minimum.

The linking member 152 is constructed of side plate portions 152A, 152B which hold fixedly both ends of the linking shaft 151, and a connecting plate portion 152C which is connected to both lower ends of the side plate portions 152A, 152B. Arm portions 152*a*, 152*b* which extend toward the table 100 to the lower front of the side plate portions 152A, 152B are formed in the lower parts of the side plate portions 152A, 152B than the linking shaft 151. A long hole 154 which extends along the arm portions 152*a*, 152*b* is formed in each of the arm portions 152*a*, 152*b*. A shaft 101 attached to the table 100 is inserted rotatably through the long holes 154. The linking member 152 is pivoted clockwise (in FIG. 3) on the linking shaft 151, and thereby the table 100 moves in the direction of an arrow.

The table 100 is in a home position (an initial position) shown in FIGS. 3 and 4 when the roller 153 is in contact with the circumferential surface of the small-radius portion 511D of the table cam 511. The table 100 moves upward when the roller 153 comes in contact with the circumferential surface of the enlarging portion 511A of the table cam 511, the table 100 then comes in contact with a lower surface of the driving-out portion 720 when the roller 153 comes in contact with the circumferential surface of the large-radius portion 511B, and the table 100 moves downward when the roller 153 comes in contact with the circumferential surface of the reducing portion 511C.

The linking shaft 151 is pressed upward by the force of a spring (not shown). If sheets T of paper to be fastened together are thick, the linking shaft 151 is moved downward so as not to constitute an obstacle to rotation of the table cam 511.

Clinchers 401, 402 are disposed in the table 100 and are rotated to clinch the ends of the sheet-staples by the clinching mechanism (not shown).

[DRIVING-OUT MECHANISM 300]

Figure 5:
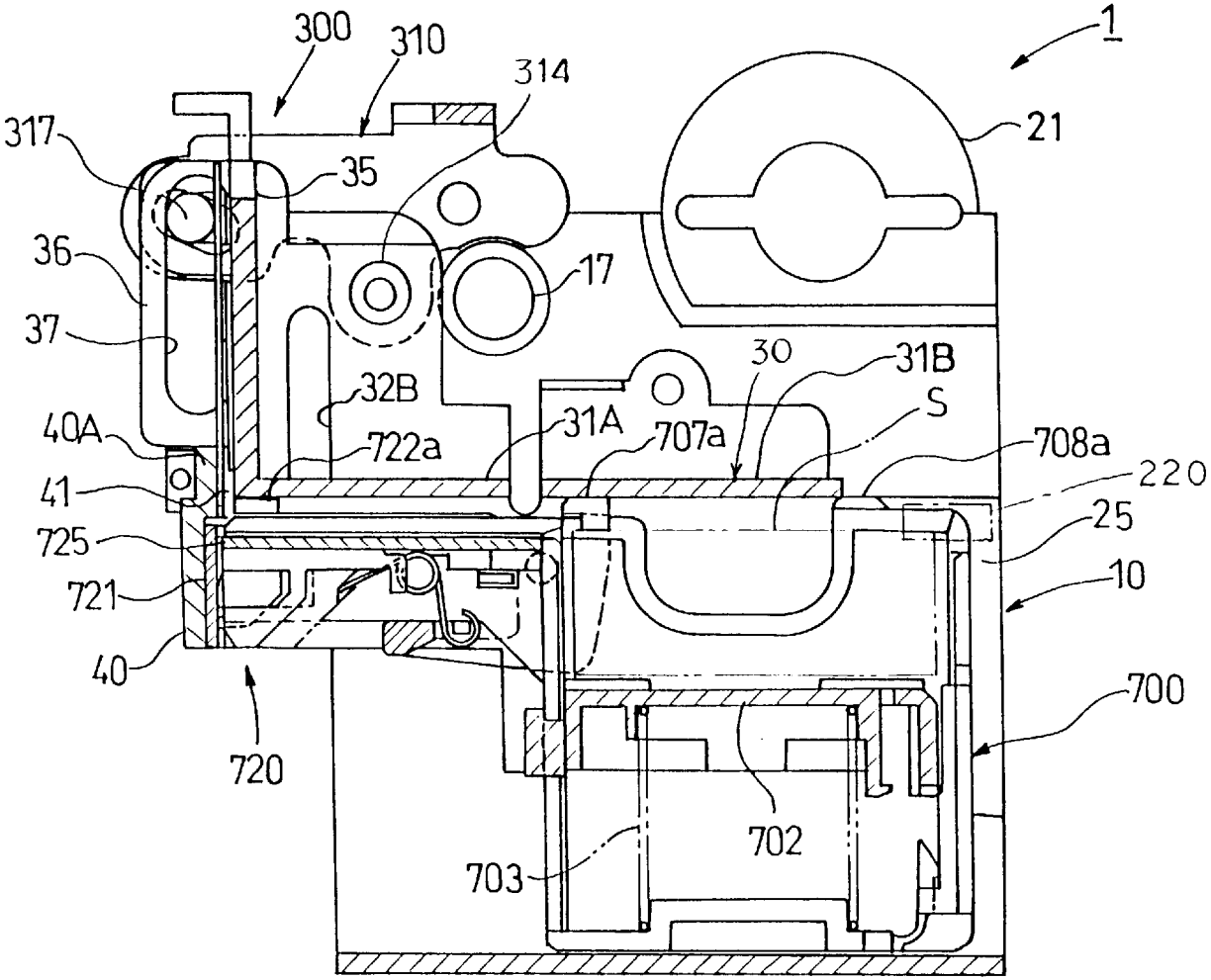
FIG. 5 is a sectional view of the electric stapler shown in FIG. 1.

As shown in FIG. 5, the driving-out mechanism 300 is constructed of driving links 310 and the driving cams 513 attached to the driving shaft 510.

The driving link 310 is pivoted on the shaft 314 by the driving cam 513 and a roller (not shown) which is in contact with the driving cam 513. The driving shaft 317 reciprocates along the long holes 37 by the pivotal movement of the driving link 310.

Figure 8:
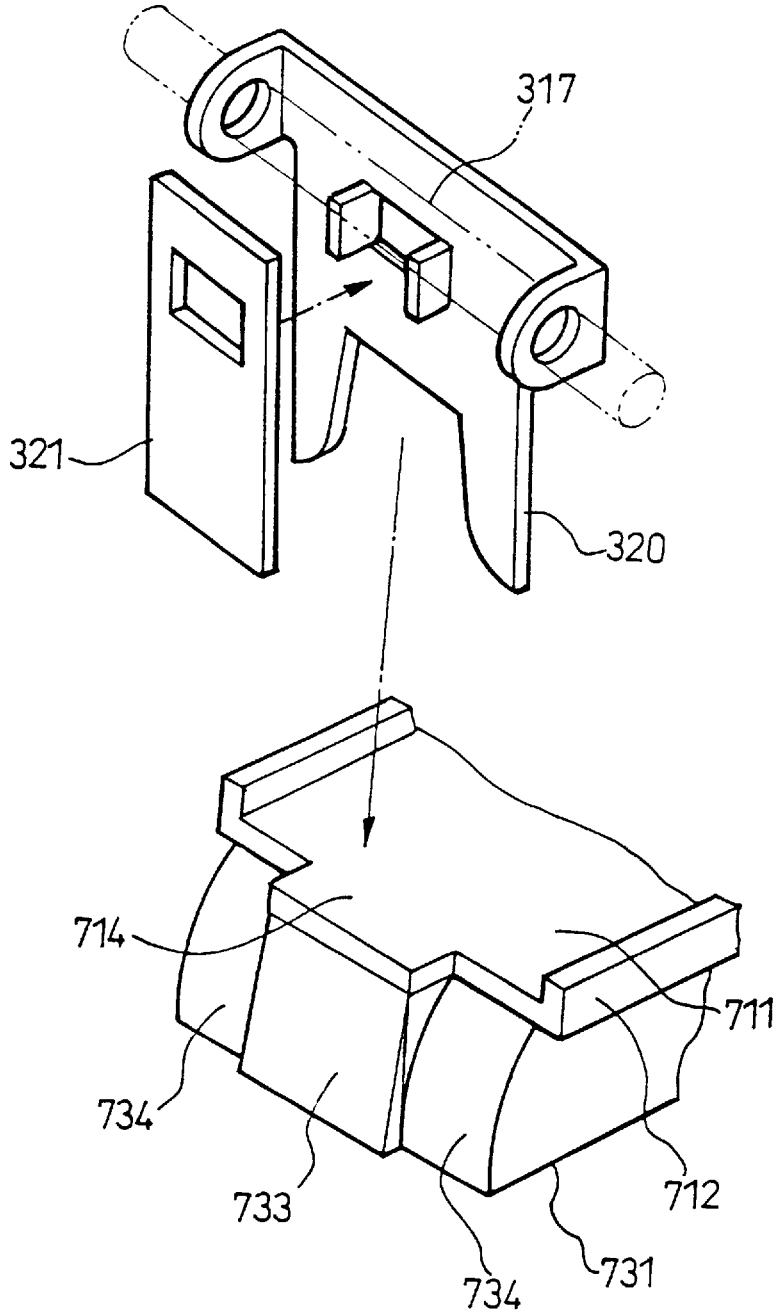
FIG. 8 is a perspective view for describing the forming of a U-shaped staple by means of a forming plate.

As shown in FIG. 8, a forming plate 320 is attached to the driving shaft 317, and a driver 321 is attached to the forming plate 320. The forming plate 320 and the driver 321 reciprocate along with the driving shaft 317.

The forming plate 320 moves downward while straddling a projection 714 formed in the front end of a staple guide, which will be described later. A staple which has been delivered to the projection 714 is shaped like the letter 'U' by the downward movement of the forming plate 320. The U-shaped staple is driven by the driver 321.

[DELIVERING MECHANISM]

Figure 9:
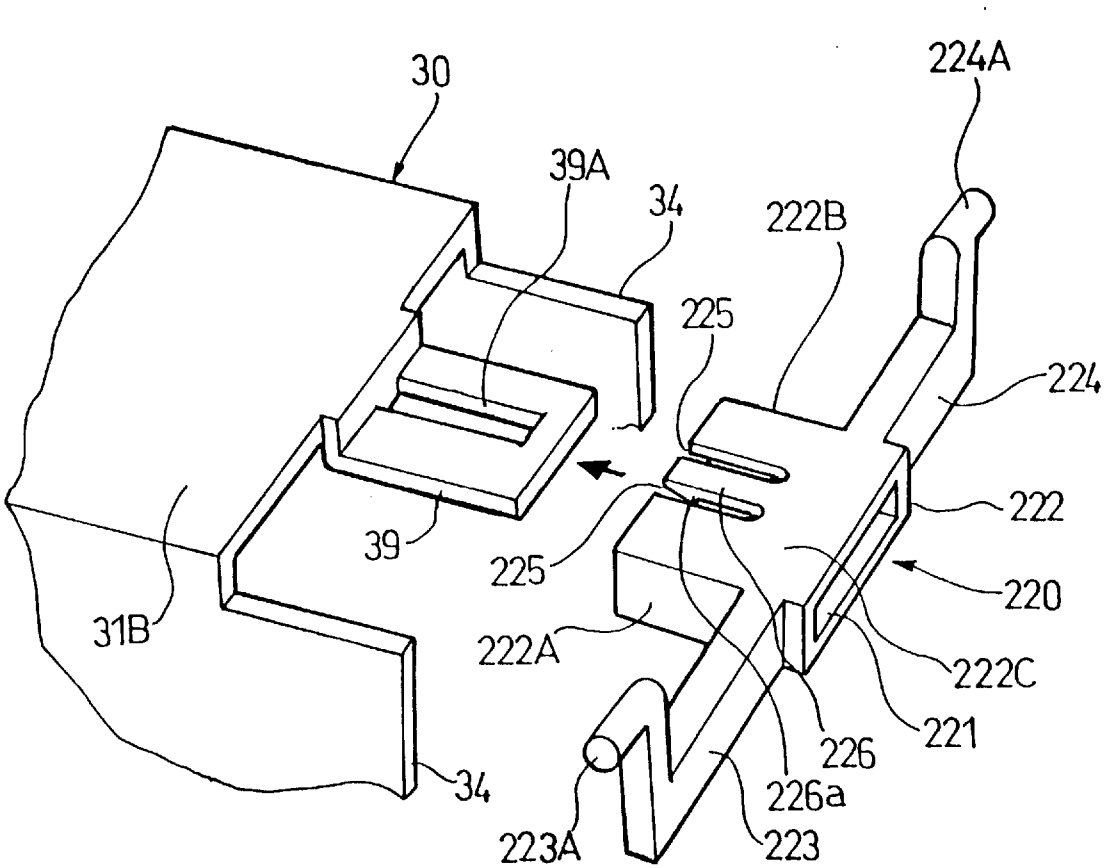
FIG. 9 is a perspective view showing a delivering plate body.
Figure 10:
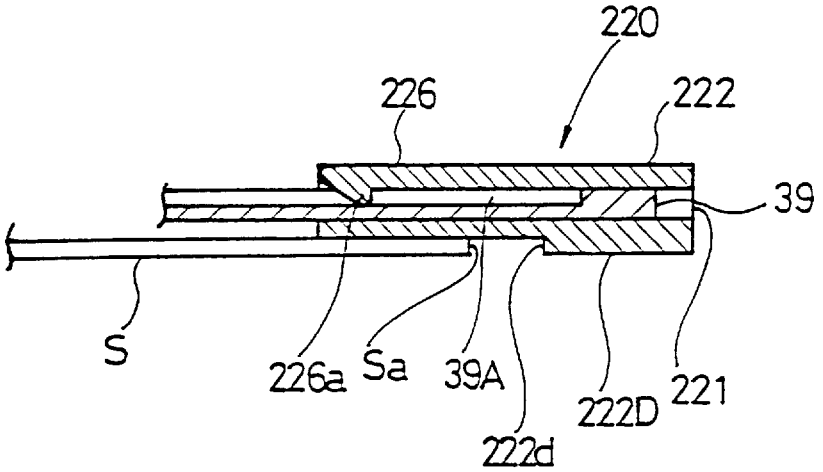
FIG. 10 is a sectional view showing the delivering plate body.

The delivering mechanism comprises the delivering cam 512 attached to the driving shaft 510 shown in FIG. 7, a delivering plate body 220 shown in FIGS. 9 and 10, a rubber roller 232 (see FIG. 12), and a delivering lever (not shown) for moving the delivering plate body 220 forward and backward in conjunction with the rotation of the delivering cam 512.

As shown in FIGS. 9 and 10, the delivering plate body 220 has a box-shaped portion 222 with a through hole 221 into which the guiding plate 39 is inserted, and arm portions 223, 224 which extend from aide walls 222A, 222B of the box-shaped portion 222 toward the side walls 34 of the magazine 30. Two slits 225 are formed in an upper plate 222C of the box-shaped portion 222. An elastic piece 226 is formed as a result of forming the two slits 225. A projection 226*a* which is engaged with a guiding groove 39A of the guiding plate 39 is formed on the elastic piece 226. A step portion (contact portion) 222*d* which comes in contact with a rear end Sa of the sheet-staple S is formed in a delivering plate 222D which is the bottom of the box-shaped portion 222.

Shafts 223A, 224A which are to be connected to the delivering lever (not shown) are formed in the arm portions 223, 224. The delivering plate body 220 is moved forward and backward by the delivering cam 512 and the delivering lever. By the forward movement of the delivering plate body 220, the step portion 222*d* of the delivering plate 222D comes in contact with the rear end Sa of the sheet-staple S, which is the uppermost one of the piled sheet-staples contained in the cartridge 700, so as to deliver the sheet-staple S forward.

[CARTRIDGE 700]

Figure 11:
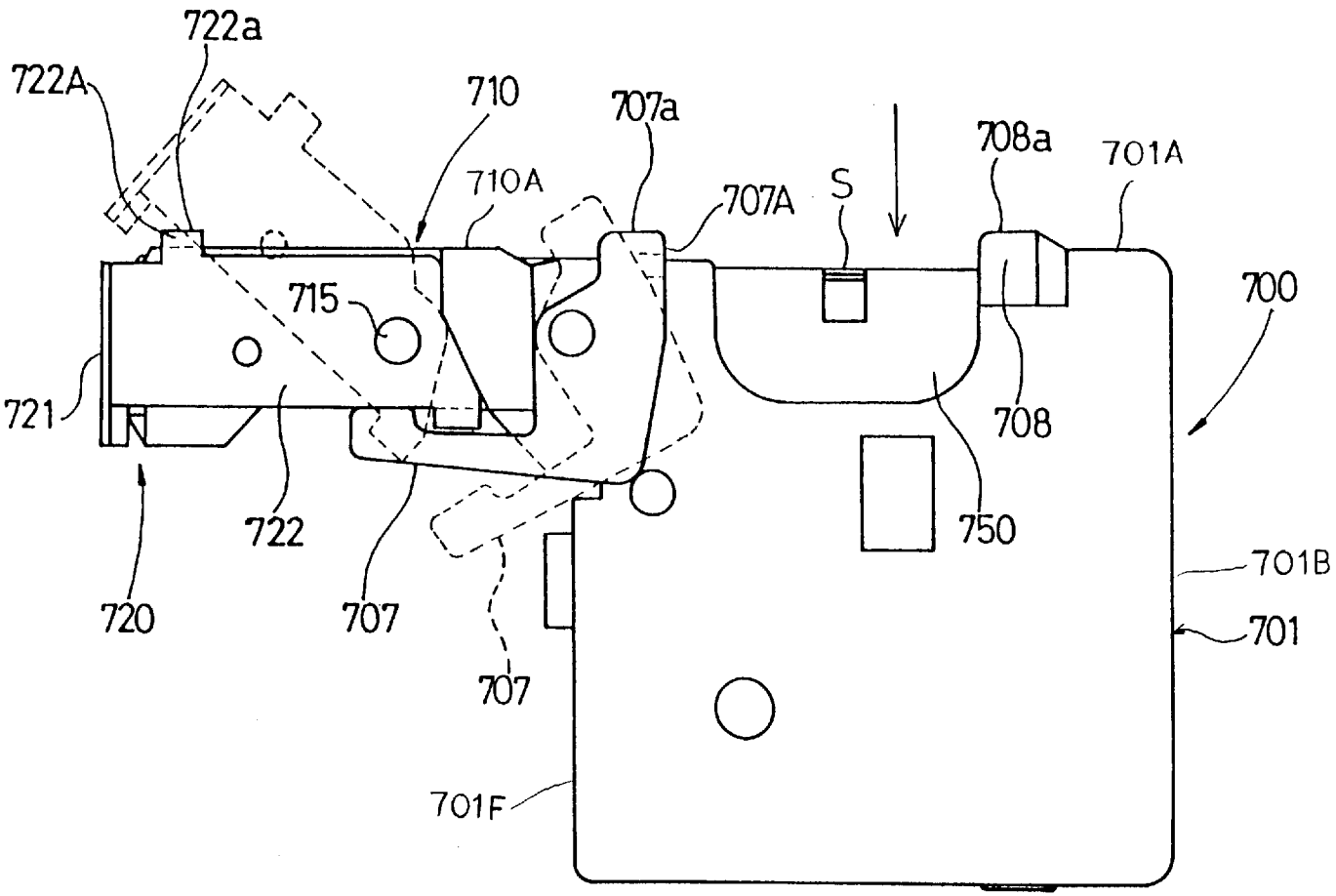
FIG. 11 is a side view showing a cartridge according to the present invention.
Figure 12:
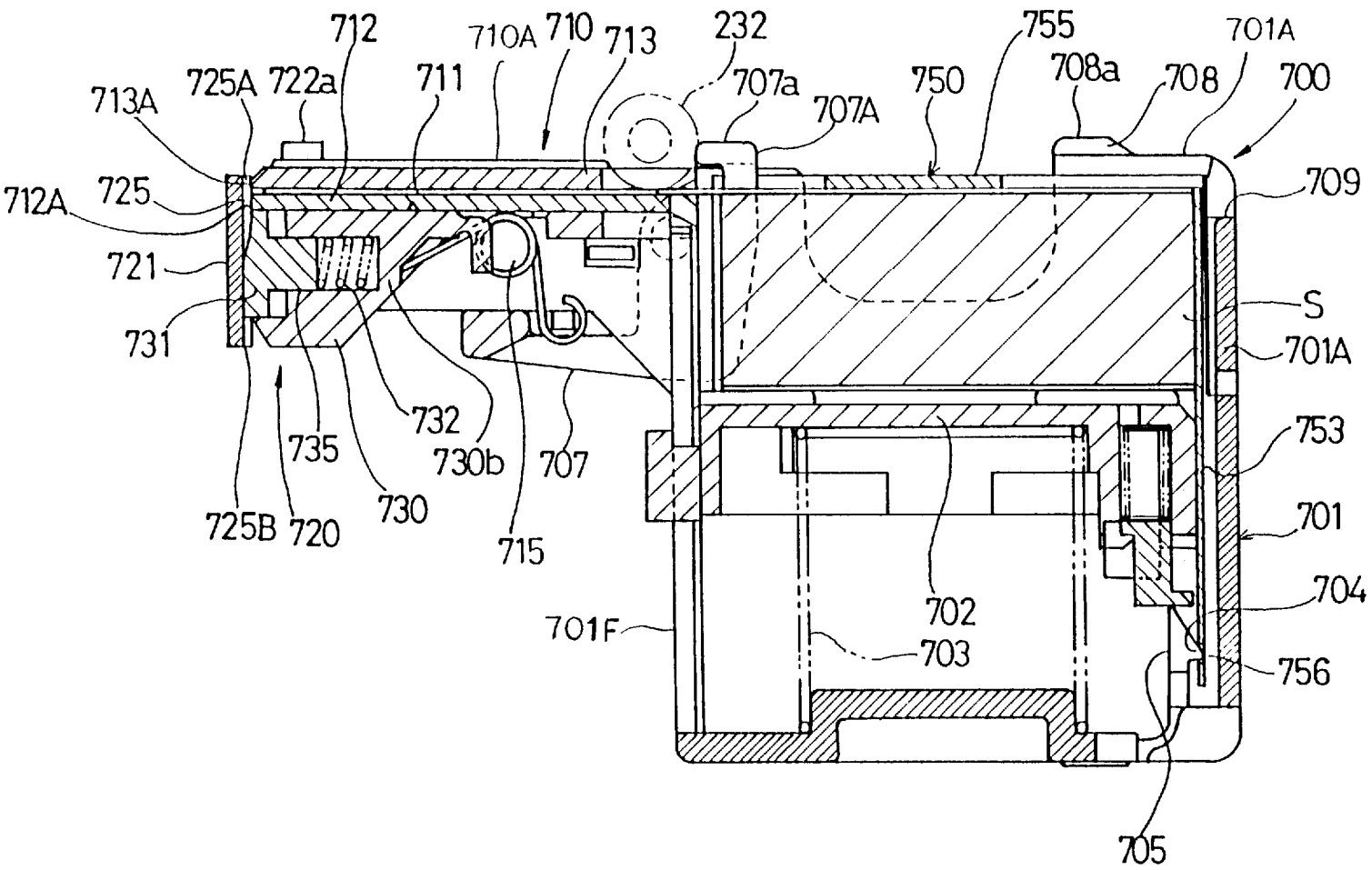
FIG. 12 is a sectional view showing the cartridge.
Figure 13:
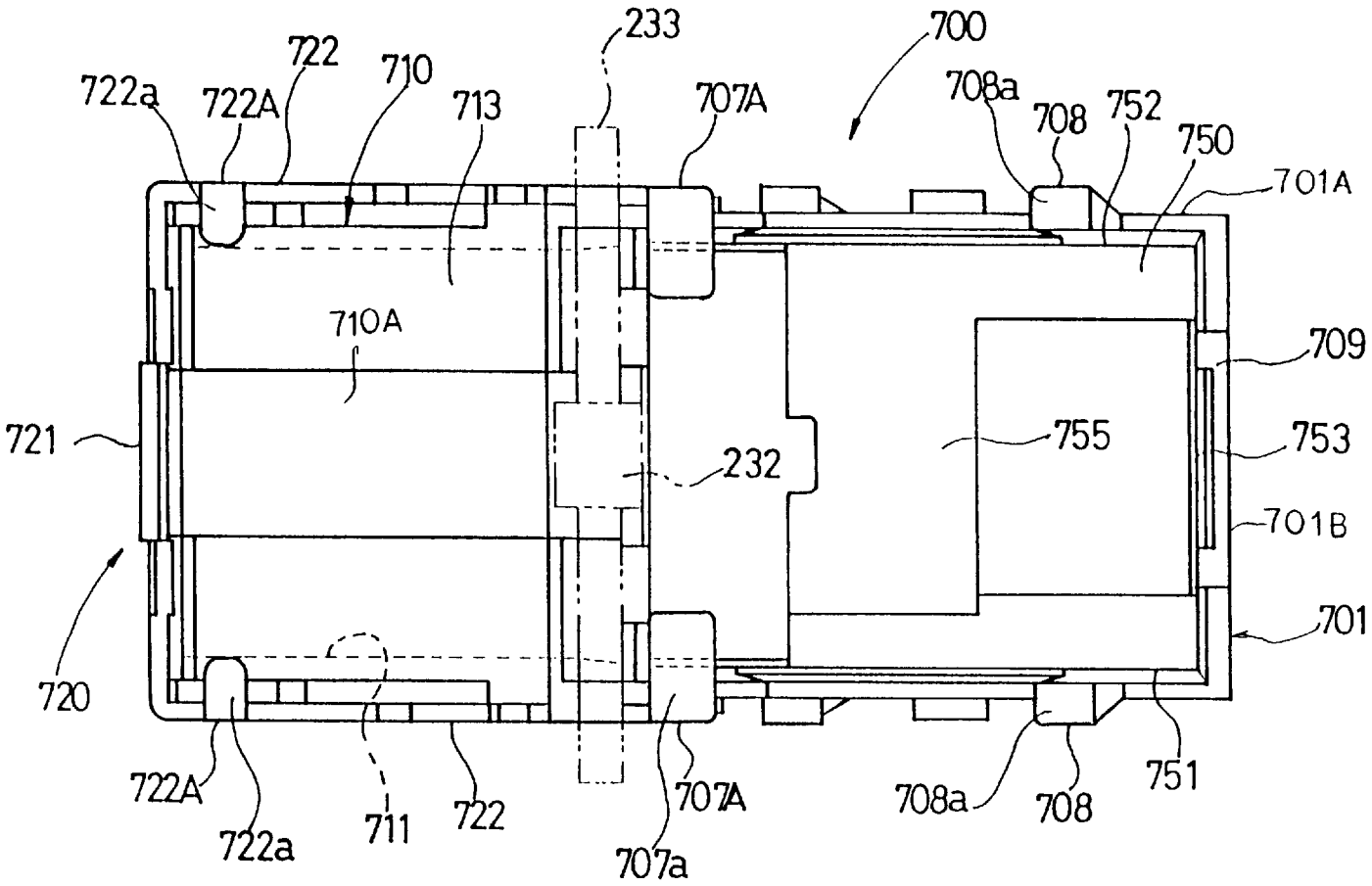
FIG. 13 is a plan view showing the cartridge.

As shown in FIGS. 11 to 13, the cartridge 700 comprises a cartridge body 701, a delivering portion 710 which extends forward (i.e., leftward in FIG. 11) from the upper end (one end) of a front wall portion 701F of the body 701, and a driving-out portion 720 which is formed in an end of the delivering portion 710. A delivery path 711 through which the sheet-staple is delivered to the driving-out portion 720 is formed in the delivering portion 710.

The cartridge body 701 includes a holder 702 movable upward and downward, a spring 703 by which the holder 702 is pressed upward, and a pair of engaging chips 705 (the other one not shown) which extend upward from the bottom and have claws 704. The holder 702 holds the piled sheet-staples S wrapped by an inner cartridge 750.

Figure 14:
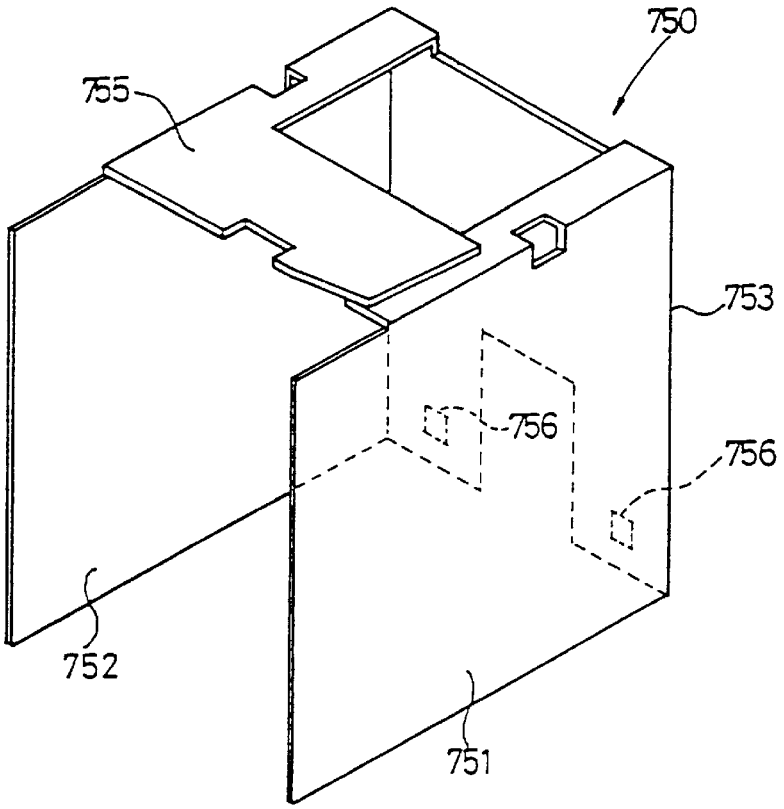
FIG. 14 is a perspective view showing an inner cartridge.

As shown in FIG. 14, the inner cartridge 750 has side walls 751, 752, a rear wall 753, and a connecting portion 755 which connects the upper parts of the side walls 751, 752. Engagement holes 756 which are to be engaged with the claws 704 of the engaging chips 705 are formed in the rear wall 753, and the engagement between the engagement holes 756 and the claws 704 enables the inner cartridge 750 to be fixed in the cartridge body 701.

In the cartridge body 701, a staple holder 707 is disposed pivotably as shown by a broken line (see FIG. 11). A surface of a sheet-staple which is the uppermost one of the piled sheet-staples S is pressed by both a pressing portion 707A of the staple holder 707 and a connecting portion 755 of the inner cartridge 750. The sheet-staples S in the inner cartridge 750 are put from the direction of an arrow shown in FIG. 11 into the cartridge body 701 together with the inner cartridge 750. At this time, the staple holder 707 is pivoted and kept at a position shown by the broken line.

In an upper part of a rear wall 701B or the cartridge body 701, a hollow portion 709 is formed which can receive the delivering plate 222D of the delivering plate body 220. By the delivering plate 222D entering the hollow portion 709, the uppermost sheet-staple S is delivered to the delivery path 711.

The delivering portion 710 comprises the staple guide 712 and a guide check 713. The staple guide 712 and the guide check 713 make up the delivery path 711.

The driving-out portion 720 comprises a face plate 721 and a pusher 731. The face plate 721 faces front ends 712A, 713A of the staple guide 712 and the guide check 713. The pusher 731 is held by a holding member 730 mounted on the lower surface of the staple guide 711. The pusher 731 is disposed under the delivery path 711 (i.e., on the other end side of the delivery path 711).

A side plate 722 is formed contiguously to each side of the face plate 721 and is supported by a side portion 730*b* of the holding member 730 through a shaft 715 so that the face plate 721 an be rotated together with the side plate 722, as shown by the broken line in FIG. 11. The face plate 721 is rotated together with the side plate portion 722 to the position shown by the broken line, so that staples staying in the space 725 of the driving-out portion 720 can be removed.

Figure 15:
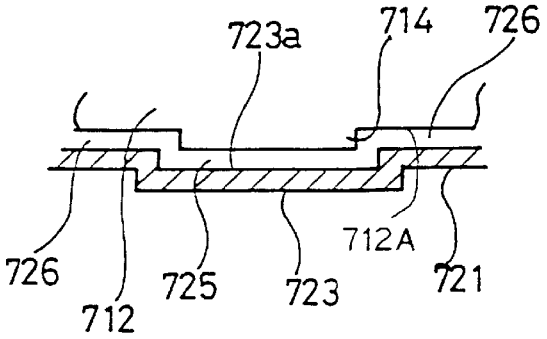
FIG. 15 is a partially enlarged view showing a driving-out portion.
Figure 17:
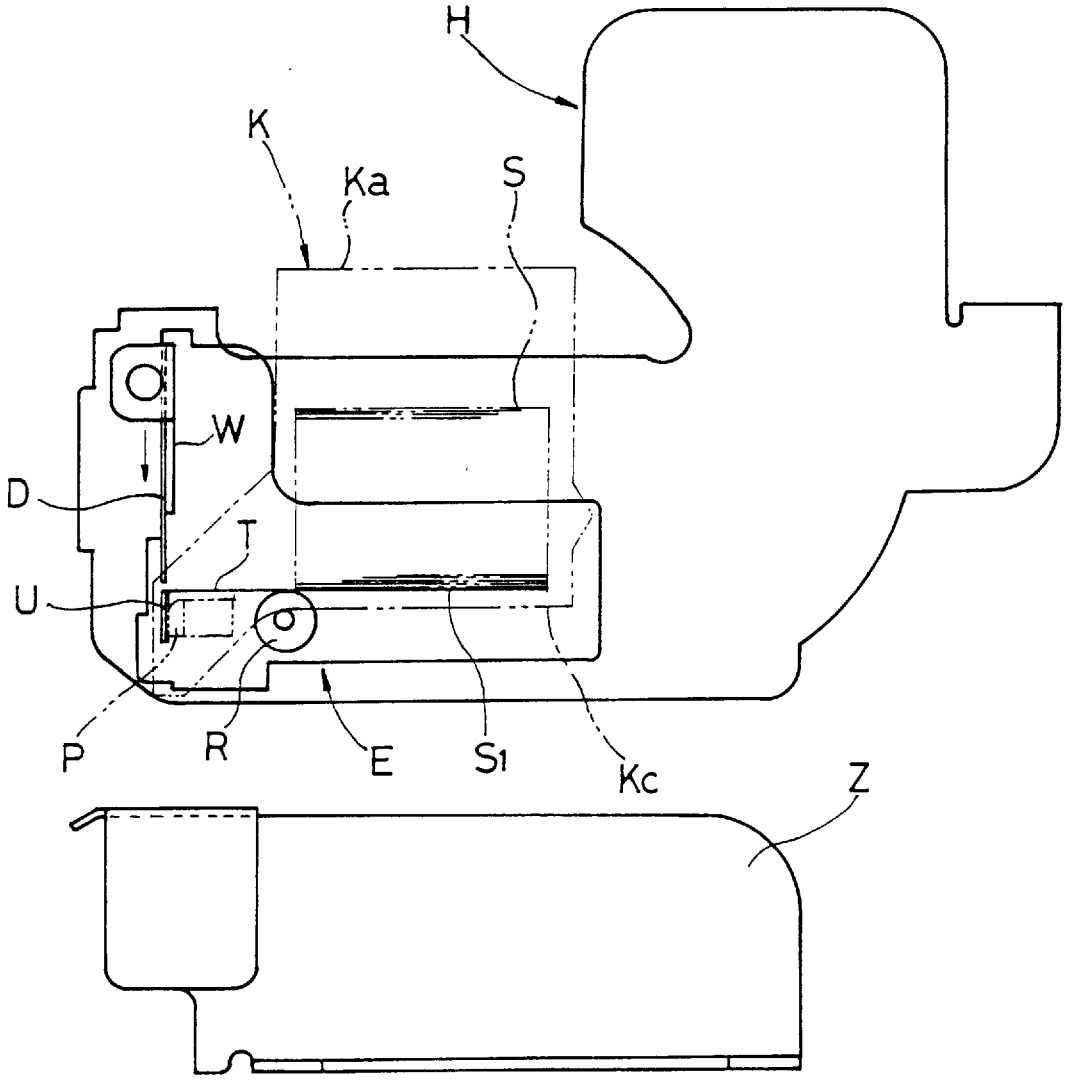
FIG.17 PRIOR ART
FIG. 17 is a schematic drawing showing a construction of a conventional electric stapler.
Figure 18:
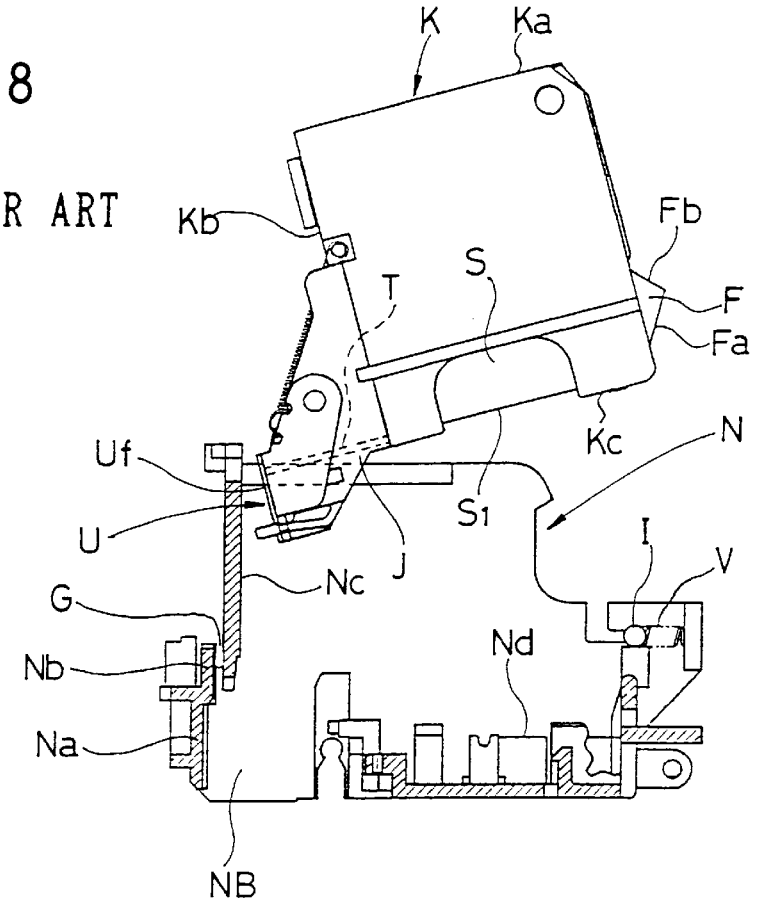
FIG.18 PRIOR ART
FIG. 18 is a descriptive drawing of a cartridge and magazine of the electric stapler of FIG. 17.
Figure 19:
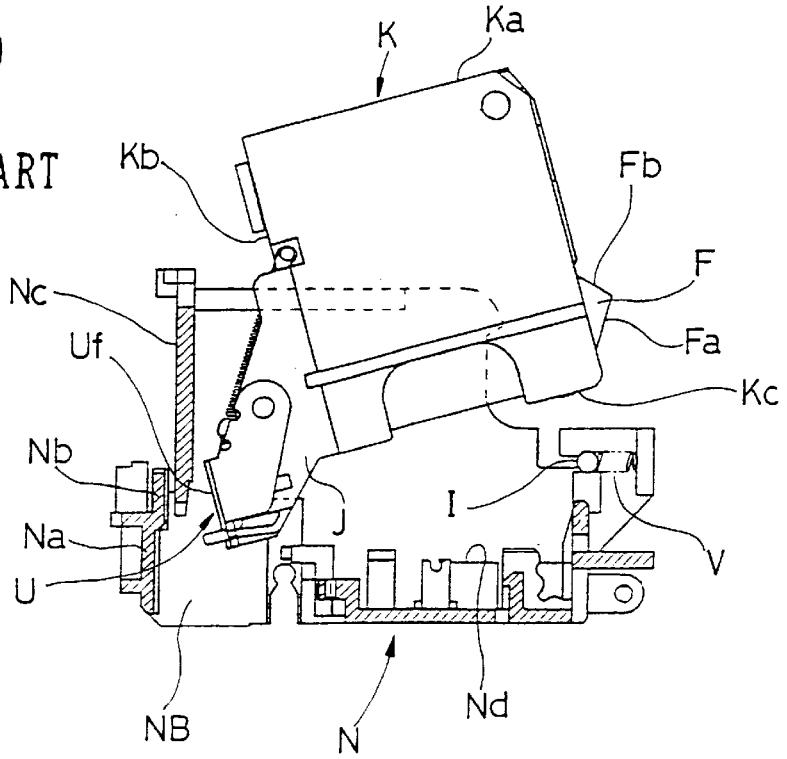
FIG.19 PRIOR ART
FIG. 19 is a descriptive drawing showing a state in which the cartridge begins to be attached to the magazine.
Figure 20:
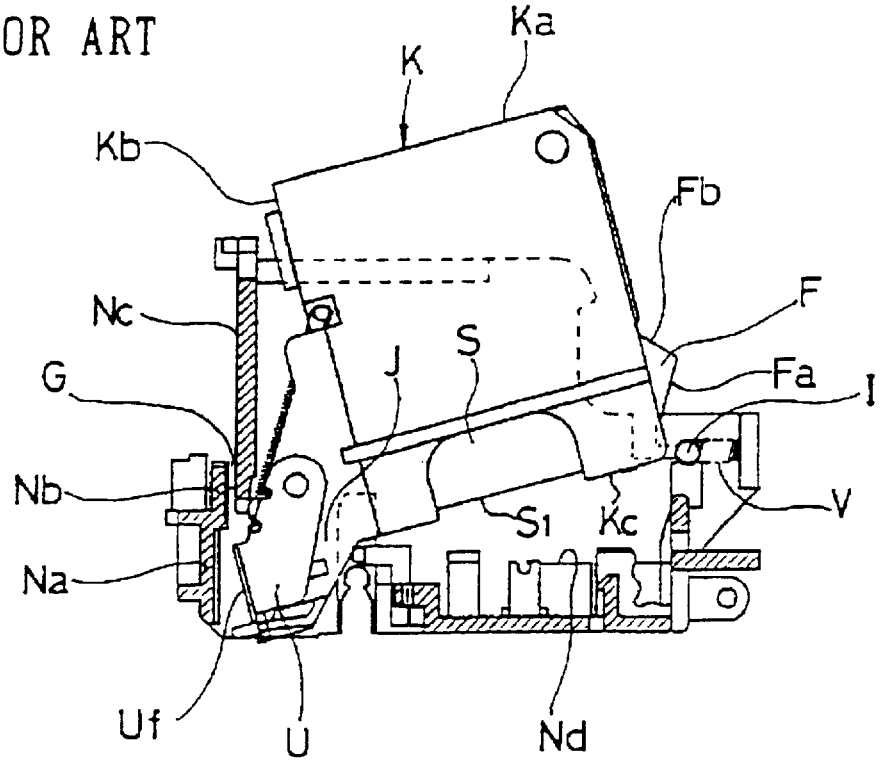
FIG. 20 PRIOR ART
FIG. 20 is a descriptive drawing showing a state before the cartridge has been attached to the magazine.
Figure 21:
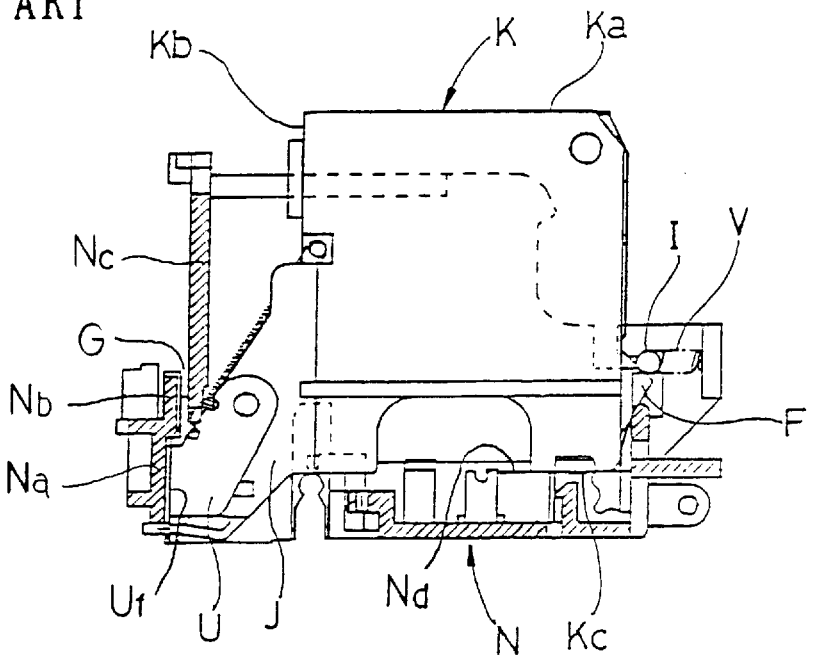
FIG. 21 PRIOR ART
FIG. 21 is a descriptive drawing showing a state in which the cartridge has been attached to the magazine.

As shown in FIG. 15, a flat-bottom hollow portion 723 which is hollowed forward is formed in the face plate 721. A space 725 is defined which extends upward and downward between an inner surface 723*a* of the hollow portion 723 and a projection 714 formed on the front end 712A of the staple guide 712. An upper part of the space 725 is an opening 725A (see FIG. 12) which the driver 321 enters. A lower part of the space 725 is a driving-out opening 725B from which the staples are driven by the driver 321.

That is, the driver 321 enters the open space 725 of the driving-out portion 720 from above the delivery path 711.

In addition, on both sides of the projection 714 of the staple guide 712, a space 726 is defined which extends upward and downward between the face plate 721 and the front part 713A of the guide check 713. The forming plate 320 can enter this space 726.

An upper plane 701A of the cartridge body 701 is designed to become flush with an upper plane 710A of the delivering portion 710. An upper plane 722*a* of a bent piece 722A formed in the upper part of the side plate portion 722 of the face plate 721, an upper plane 707*a* of the pressing portion 707A of the staple holder 707, and an upper plane 708*a* of a projection 708 formed in the upper part of the side wall of the cartridge body 701 are also designed to become flush with each other. The upper plane 722*a* of the bent piece 722A, the upper plane 707*a* of the pressing portion 707A, and the upper plane 708*a* of the projection 708 come in contact with the lower plane of the bottoms 31A, 31B of the magazine 30 (see FIG. 5). Merely by inserting the cartridge 700 from the rear part of the stapler body 10, the cartridge 700 is attached to the cartridge chamber 25, as shown in FIG. 5.

The staples are driven such that the driver is moved downward from above and enters the space 725 of the driving-out portion 720. For this reason, the pusher 731 is mounted under the delivery path 711. Accordingly, the upper plane 710A of the delivering portion 710 can be designed to be flat and become flush with an upper plane 701A of the cartridge body 701.

In addition, the cartridge 700 is designed to be pulled back and removed from the cartridge chamber 25 when a lever 5 (see FIG. 3) mounted in the electric stapler body 10 is raised to a position shown by a phantom line.

When the cartridge 700 is attached to the cartridge chamber 25 of the electric stapler body 10, the face plate 721 of the cartridge 700 comes in contact with a front wall 40 of the lower part of the electric stapler 10, and a space 41 defined by the front wall 40 and the like is designed to coincide with the spaces 725, 726 of the driving-out portion 720.

[OPERATION OF ELECTRIC STAPLER]

There will now be described the operation of the electric stapler 1 constructed as above.

First, the cartridge 700 containing a pile of sheet-staples S is inserted from the rear part of the stapler body 10 and is attached to the cartridge chamber 25 of the stapler body 10. All that is required for the attachment is to insert it from the rear part of the stapler body 10. The attachment operation is very easy.

When the motor X is not running, the table 100 is in an initial position shown in FIG. 3. At this time, the table cam 511 is also in an initial position shown in FIG. 3, and the small-radius portion 511D of the table cam 511 is in contact with the roller 153.

When the motor M is driven by a stapling signal from a copying machine, the cam-driving shaft 510 is rotated counterclockwise (in FIG. 3) through the gears 501 to 504, and the cams 511 to 514 are rotated together with the cam-driving shaft 510.

When the roller 153, by the rotation of the table cam 511, begins to come in contact with the circumferential surface of the enlarging portion 511A from that of the small-radius portion 511D of the table cam 511, the linking member 152 is pivoted clockwise on the linking shaft 151, and the table 100 begins to move upward.

When the table 100 moves upward, the delivering plate body 220 is moved forward by the delivering cam 512 and the delivering lever (not shown). Thereby, the step portion 222*d* of the delivering plate 222D comes in contact with the rear end Sa of the uppermost sheet-staple S in the cartridge 700 pushes the sheet-staple S forward. That is, in the beginning of the attachment of the cartridge 700, the sheet-staple S is delivered by a given distance from the cartridge 700 by means of the delivering plate 222D and is delivered forward even more by the rotation of the roller 232.

When the roller 153 begins to come in contact with the circumferential surface of the large-radius portion 511B of the table cam 511, in other words, when the cam-driving shaft 510 is rotated in a substantially 90-degree arc, the table 100 moves upward to a position (a top dead point) of the lower surface 720A of the driving-out portion 720 and holds the sheets T therebetween.

While the roller 153 is in contact with the circumferential surface of the large-radius portion 511B of the table cam 511, the table 100 remains at the top dead point and the sheets T remain held. While the sheets T are held, the forming plate 320 and the driver 321 move downward even more along with the driving shaft 317 and enter the spaces 725, 726 of the driving-out portion 720. In a case where staples S1, S2 are in the spaces 725, 726, as shown in FIG. 16*a*, the forming plate 320 shapes the staple S2 like the letter "U", and the driver 321 drives the U-shaped staple S1 from the driving outlet 725B of the driving-out portion 720 into the sheets T.

When the staple S1 is driven into and has passed through the sheets T, the clinchers 401, 402 are rotated to clinch the ends Sc of the staple S1 by the clinching mechanism (not shown). After that, the roller 153 comes in contact with the circumferential surface of the reducing portion 511C, and the table 100 moves downward and returns to the home position.

When the sheet-staples S are contiguously laid between the driving-out portion 720 and the cartridge 700, the delivering plate body 220 moves the sheet-staples S by a distance corresponding to the length of one sheet-staple and is locked. The delivering cam 512 can rotate smoothly by means of the delivering lever.

In order to detach the cartridge 700 from the cartridge chamber 25 of the stapler body 10, the lever 5 is raised to the position shown by the phantom line (see FIG. 3). Thereby, the cartridge 700 is pulled back from the cartridge chamber 25. The cartridge 700 is detached merely by drawing it backward. The detaching operation of the cartridge 700 is very ease.

In a case in which the electric stapler 1 is attached to the copying machine upside down (i.e., the table 100 is disposed with the face upward whereas the driving-out portion 720 is disposed with the face downward), the cartridge 700 is attached to the stapler body 10 merely by inserting the cartridge 700 from the rear part of the stapler body 10, as described above. Therefore, the attachment of the cartridge 700 can be easily carried out. The removal of the cartridge 700 can be also easily carried out merely by pulling the cartridge 700 backward.

In the above-mentioned embodiment, a description was given of the case in which the electric stapler 1 is mounted in the copying machine. But, the present invention is not limited to this. The electric stapler 1 may be mounted in a printer, a fax machine, or the like.

What is claimed is:

1. A cartridge for an electric stapler comprising:

a cartridge body containing a pile of sheet-staples;

a delivering portion mounted in an end of said cartridge body and having a delivery path for delivering the sheet-staples; and a driving-out portion mounted in a front end of said delivering portion;

a U-shaped staple being driven from said driving-out portion by a reciprocating driver entering said driving-out portion;

wherein said driver is caused to enter said driving-out portion from said end of said cartridge body toward an opposite end thereof.

2. A cartridge for an electric stapler according to claim 1, wherein said driving-out portion includes a pusher for pushing legs of the U-shaped staple forward, said pusher being mounted below said delivery path in a case in which said cartridge body is placed such that a side of said delivery path faces upward.

3. A cartridge for an electric stapler according to claim 1, wherein said driving-out portion includes a face plate disposed in front of said delivering portion, and a space which said driver enters is defined between said face plate and the front end of said delivering portion, said face plate being mounted rotatably with respect to said delivering portion so that the space can be released.

4. A cartridge for an electric stapler according to claim 3, further comprising a side plate portion mounted rotatable on a side surface of said delivering portion and formed contiguously with opposite sides of said face plate.

5. A cartridge for an electric stapler according to claim 1, wherein said cartridge body has a hollow portion formed in an end of a rear wall of said cartridge body, and a delivering plate for delivering the sheet-staples to said delivery path enters said hollow portion.

* * * * *